US006826932B2

(12) United States Patent
Sonoda et al.

(10) Patent No.: US 6,826,932 B2
(45) Date of Patent: Dec. 7, 2004

(54) DRUM-TYPE WASHING MACHINE

(75) Inventors: Yasuaki Sonoda, Hirakata (JP); Hiroshi Yamamoto, Neyagawa (JP); Yasuhiko Yokoi, Otsu (JP); Takao Kinouchi, Hirakata (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/241,779

(22) Filed: Sep. 12, 2002

(65) Prior Publication Data

US 2003/0046962 A1 Mar. 13, 2003

(30) Foreign Application Priority Data

Sep. 13, 2001 (JP) ..... 2001-277738

(51) Int. Cl.[7] ..... D06F 37/22

(52) U.S. Cl. ..... 68/12.06; 68/23.1; 68/23.4; 68/23.5; 73/573 F

(58) Field of Search ..... 68/12.06, 23.1, 68/23.2, 23.4, 23.5; 73/573 F

(56) References Cited

FOREIGN PATENT DOCUMENTS

| | | | |
|---|---|---|---|
| JP | 2001-029682 | * | 2/1991 |
| JP | 11-028298 | * | 2/1999 |

* cited by examiner

*Primary Examiner*—Frankie L. Stinson
(74) *Attorney, Agent, or Firm*—Armstrong, Kratz, Quintos, Hanson & Brooks, LLP

(57) ABSTRACT

A washing machine 10 of the drum type comprises a drum 20 rotatable about a horizontal or inclined center of rotation, a drive motor 50 for rotating the drum, liquid holding chambers 36 for holding a liquid therein centrifugally, means for detecting an eccentric load of laundry in the drum, and control means 72 for adjusting the amounts of liquid in the chambers in accordance with the detected eccentric load. The amounts of liquid in the chambers are adjustable by braking the drum in rotation. The machine has moment of inertia measuring means 60 for detecting the rotation of the drum. The control means calculates the moment of inertia acting on the drum based on the rotation of the drum detected by the moment of inertia measuring means, and adjusts the magnitude of braking force to be applied to the drum in accordance with the calculated moment of inertia so as to decelerate the drum at a constant rate in adjusting the amounts of liquid in the chambers.

8 Claims, 10 Drawing Sheets relationship between the Hall element pulse interval and the moment of inertia

DRUM-TYPE WASHING MACHINE

FIELD OF THE INVENTION

The present invention relates to washing machines of the drum type having a drum which is rotatable with the center of rotation thereof positioned horizontally or as inclined.

BACKGROUND OF THE INVENTION

FIG. 10 shows a drum-type washing machine 90 which comprises a drum 91 rotatable in a horizontal or inclined state for washing laundry and dewatering therefrom. The drum 91 is disposed in and rotatably supported by an outer tub 92, coupled to a drive motor 93 on the outer tub 92 by a belt 94 and pulleys 95, 95 and rotated by the motor 93.

Especially when water is removed, the wet laundry in the washing machine 90 is positioned eccentrically on the inner peripheral wall of the drum 91 by a centrifugal action, with the result than an unbalanced load occurs on the drum 91, producing imbalance under gravity around the center of rotation and giving rise to the problem of vibration or noise.

To prevent the vibration from being transmitted to the outside, vibration reducing dampers 97 and springs 97*a* are arranged between the outer tub 92 supporting the drum 91 and the machine cabinet 96.

In order to prevent the occurrence of an eccentric load to diminish vibration and noise, some washing machines have a plurality of liquid holding chambers 98 provided at a drum end and equidistantly arranged in the same direction, and means 99 for detecting the position of eccentricity of the load. The amounts of liquid in the liquid holding chambers 98 are adjusted in accordance with the position of eccentric load detected by the eccentric load detecting means 99 to offset the eccentric load of the drum 91 and reduce the vibration and noise.

Washing machines are conventionally available wherein the outer tub 92 is provided with an acceleration sensor serving as the eccentric load detecting means 99 and adapted to detect the acceleration in the upward or downward direction of the outer tub 92 to specifically determine the position of eccentric load.

The amounts of liquid in the liquid holding chambers 98 are adjusted by supplying approximately uniform amounts of water to the chambers 98 in advance, and momentarily reversely rotating the drive motor 93 upon the position of eccentric load reaching approximately a position exactly above the center of rotation of the drum 91 to brake the motor by the reverse rotation and allow the water to spontaneously fall from the chambers 98 on the side of eccentric load.

However, since the magnitude of braking force remains the same regardless of the weight of the laundry, the brake is less effective when the weight of the laundry is great, and the amounts of water in the chambers 98 not located at the position of the eccentric load diminish. For this reason, the balance of eccentric weight under gravity remains uncorrected despite the adjustment of amounts of water in the chambers 98, augmenting the vibration of the drum 91.

An object of the present invention is to provide a drum-type washing machine wherein the magnitude of braking force is altered in accordance with the weight of laundry in the drum by detecting the moment of inertia of the drum so as to make it possible to correctly adjust the amounts of liquid in liquid holding chambers.

SUMMARY OF THE INVENTION

To fulfill the above object, the present invention provides a washing machine of the drum type comprising:

a drum rotatable about a horizontal or inclined center of rotation with laundry placed therein for washing the laundry and dewatering therefrom, a drive motor for rotating the drum, a plurality of liquid holding chambers arranged circumferentially of the drum at equal intervals for holding a liquid therein by a centrifugal force produced by the rotation of the drum, means for detecting an eccentric load due to uneven presence of the laundry within the drum, and control means for determining the position and magnitude of the eccentric load detected and adjusting the amounts of liquid in the liquid holding chambers in accordance with the position and magnitude of the eccentric load, the amounts of liquid in the liquid holding chambers being adjustable by braking the drum in rotation.

The washing machine has moment of inertia measuring means for detecting the rotation of the drum. The control means calculates the moment of inertia acting on the drum based on the rotation of the drum detected by the moment of inertia measuring means, and adjusts the magnitude of braking force to be applied to the drum in accordance with the calculated moment of inertia so as to decelerate the drum at a constant rate in adjusting the amounts of liquid in the liquid holding chambers.

The moment of inertia detecting means detects the rotation of the drum having laundry placed therein, for example, the speed of rotation or the number of revolutions of the drum, and the control means calculates the moment of inertia from the data obtained. The moment of inertia of the drum varies with the weight of the laundry, so that in adjusting the amount of liquid in the liquid holding chambers, if the magnitude of braking force is so adjusted as to decelerate the drum at a constant rate based on the moment of inertia of the drum, the drum can be decelerated at the same position irrespective of the weight of the laundry, and the amount of liquid in the chambers is adjustable in accordance with the position of eccentric load.

The changes of polarity of the magnetic poles of the drive motor are detected as moment of inertia measuring means to detect the rotation of the drum from the rotation of the drive motor, so that the moment of inertia can be measured also accurately. The braking force is adjusted based on the information as to the moment of inertia as accurately determined, whereby the amounts of liquid in the liquid holding chambers can be adjusted accurately to assure the drum of weight balance and result in diminished vibration and lower noise.

Hall elements which are generally provided on drive motors can be utilized as the magnetic pole detecting means. This serves to reduce the increase in the number of parts and to suppress the cost increase.

When a direct drive motor is used as the drive motor so as to connect the drum directly to the rotation shaft of the drive motor without using any reduction gear, no slippage occurs between the drum and the drive motor. The rotation of the drive motor is then in match with that of the drum, permitting the measurement of the moment of inertia with higher accuracy.

DESCRIPTION OF THE REFERRED EMBODIMENT

The drum-type washing machine 10 of the invention will be described below.

Figure 1:
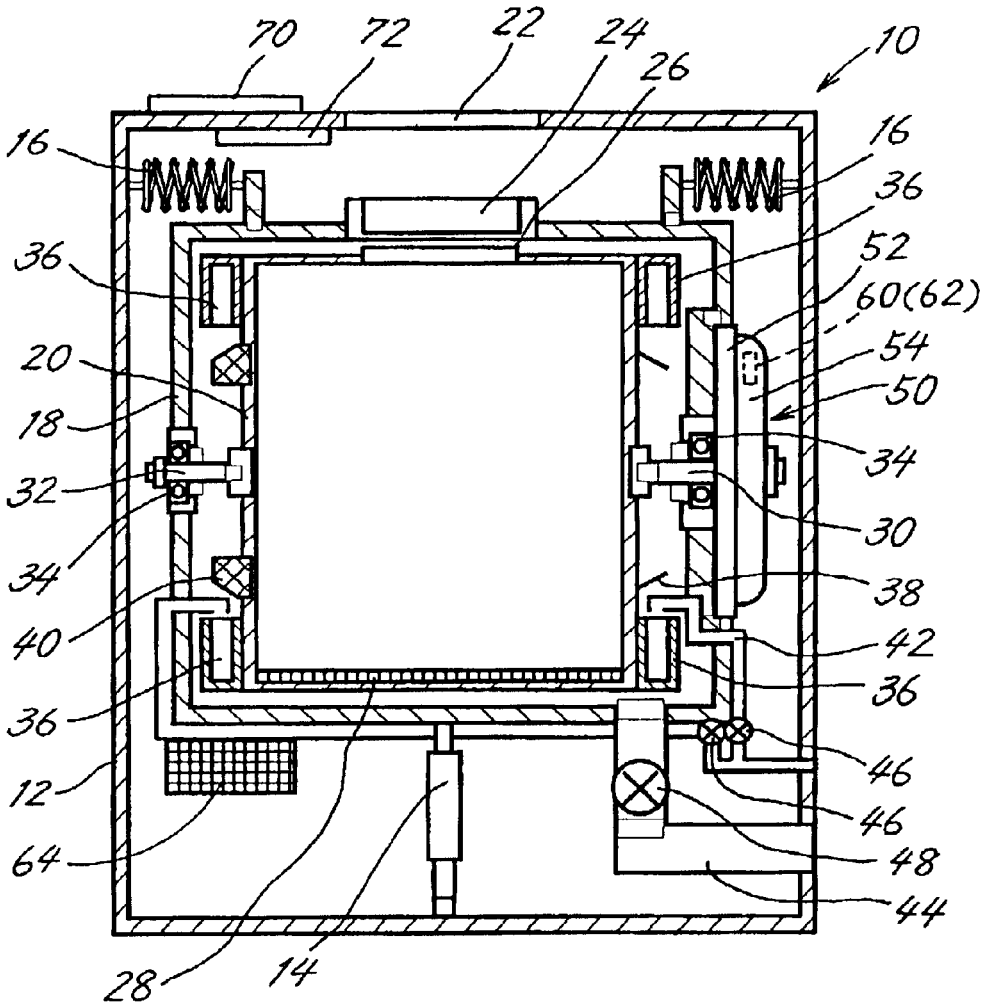
FIG. 1 is a view in section of a drum-type washing machine of the invention.

FIG. 1 is a sectional view showing the overall construction of the washing machine 10. The machine 10 has an outer tub 18 disposed inside a machine cabinet 12 and supported by a damper 14 and springs 16, 16 attached to the cabinet. A hollow cylindrical drum 20 is rotatably supported inside the outer tub 18.

The illustrated washing machine 10 is of the type wherein laundry is placed into the drum through an upper portion of the cabinet 12. Laundry inlets 22, 24 for placing in and taken out the laundry therethrough are formed in the upper walls of the respectively cabinet 12 and outer tub 18. Also formed in the periphery of the drum 20 is a laundry inlet 26 which can be positioned in register with the laundry inlet 24 of the outer tub 18. The laundry inlets 22, 24, 26 are each provided with a door (not shown). A laundry inlet may be provided in a side portion of the washing machine.

The drum 20 is in the form of a hollow cylinder having closed opposite ends and has many water passing holes (not shown) in its peripheral wall. A plurality of baffles (not shown) are provided on the inner surface of the wall for scraping up the laundry. Provided on the inner peripheral surface of the drum 20 in opposed relation with the laundry inlet 26 is a weight balancer 28 corresponding to the weight of the laundry inlet 26 and in balance with the weight of the inlet 26 (including the door).

The drum 20 has rotation shafts 30, 32 projecting outward from its opposite ends centrally thereof and rotatably supported by bearings 34, 34 on the outer tub 18. The rotation shaft 30 serves also as the rotation shaft of a drive motor 50 (to be described later) disposed externally of the outer tub 18.

The drum 20 is provided at its opposite ends with liquid holding chambers 36 arranged circumferentially thereof at equal intervals. The chambers 36 are positioned at equal distances from the center of rotation of the drum 20 and are opened toward the center of rotation.

One end face of the drum 20 has an annular cover plate 38, by which the liquid (to be described later) spilling under gravity from the liquid holding chambers 36 passing on the upper side of the center of rotation is prevented from entering the liquid holding chambers 36 on the lower side.

The other end face of the drum 20 has a hollow annular fluid balancer 40 attached thereto. Placed in the fluid balancer 40 is a liquid in an amount corresponding to about half the volume of space therein. The inner periphery of the fluid balancer 40 serves also as the above-mentioned cover plate.

Connected to the outer tub 18 are a water supply pipe (not shown) for supplying water for washing and rinsing to the interior of the tube 18, a water injection pipe 42 for supplying liquid (i.e., water in this embodiment) to the liquid holding chambers 36, and a drain pipe 44 for discharging water from inside the outer tub 18.

The water injection pipe 42 has one end connected to water supply equipment (not shown). Via water injection valves 46, 46 and from other ends extending through the wall of the outer tub 18, water can be supplied to the liquid holding chambers 36, 36 as positioned immediately below the center of rotation of the drum 20. When the valves 46, 46 are opened, water is held in the chambers 36 on the lower side.

The drain pipe 44 has one end connected to a lower portion of the outer tub 18, a drain valve 48 at an intermediate portion thereof and the other end communicating with a drain opening (not shown). Water is held in the outer tub 18 when the drain valve 48 is closed, and the water is discharged to the outside when the drain valve 48 is opened.

The drive motor 50 is disposed on the side wall of the outer tub 18. The drive motor 50 can be, for example, a direct drive motor. In this case, the rotation shaft of the drive motor 50 serves also as the rotation shaft 30 of the drum 20 as previously stated.

The drive motor 50 is controlled by the control means 72 to be described below, and comprises a stator 52 fixed to the outer tub 18 and a rotor 54 rotatably fitted to the stator 52.

Figure 2:
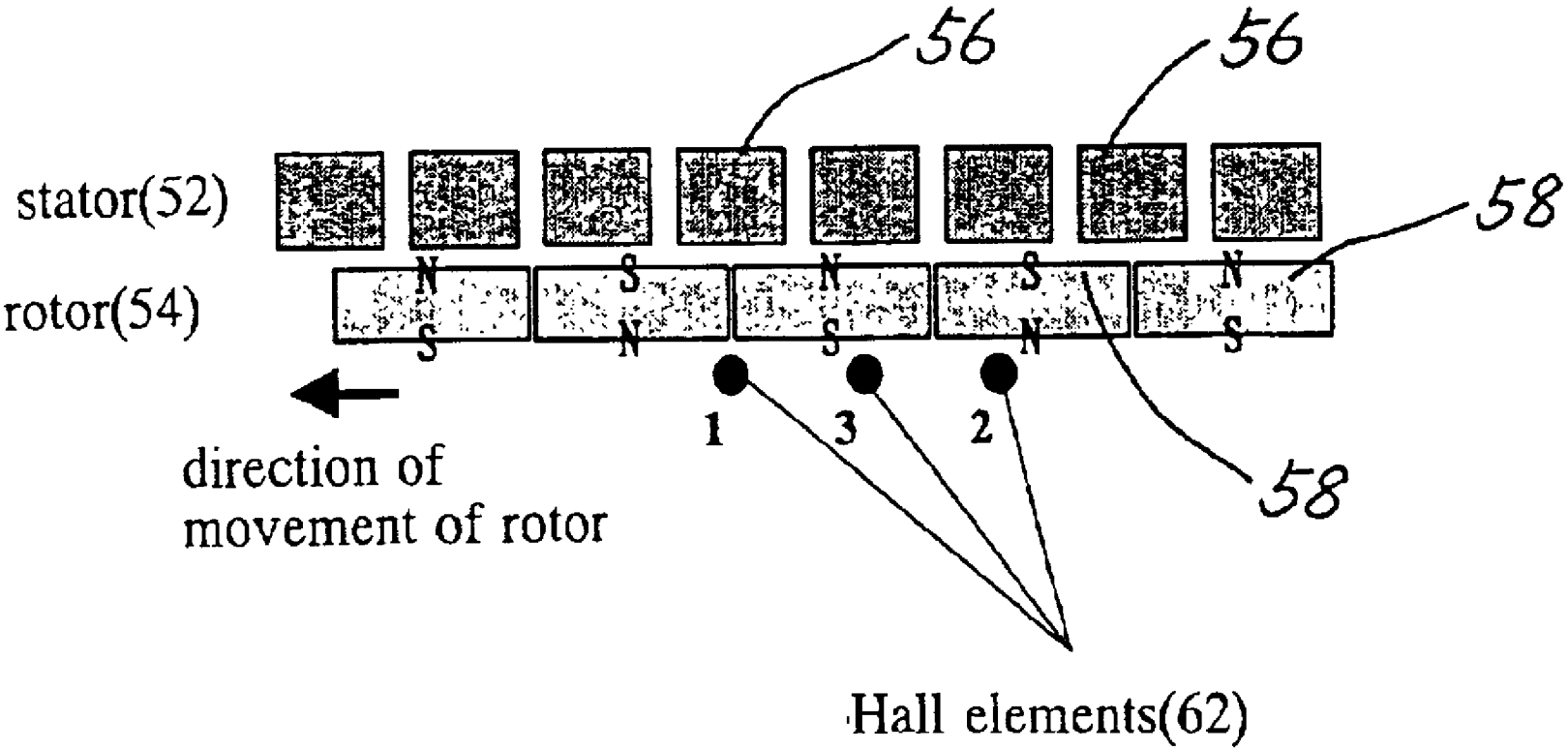
FIG. 2 is a diagram showing the relationship in position between a stator, rotor and Hall elements.

As shown in FIG. 2, the stator 52 comprises an arrangement of coils 56, and the rotor 54 comprises magnetic poles arranged alternately in proximity to the coils 56. The rotor 54 rotates forward or reversely by applying a drive voltage to the coils 56 from the control means 72.

With reference to FIG. 2, the rotor 54 is provided close to the poles 58 with one or a plurality of magnetic pole detecting means 60 on one side thereof opposite to the coils 56 of the stator 52. The magnetic pole detecting means 60 can be, for example, a Hall element 62. FIG. 2 shows three Hall elements 62 arranged at equal intervals. The Hall elements 62 are electrically connected to the control means 72 to be described below and transmit to the control means 72 a "high" signal upon detecting S pole of the magnetic poles and a "low" signal upon detecting N pole.

A dryer unit 64 is disposed on the outer bottom surface of the outer tub 18 (see FIG. 1).

The machine cabinet 12 is further provided with an operation panel 70 having a manual unit 66 and a display unit 68.

Figure 3:
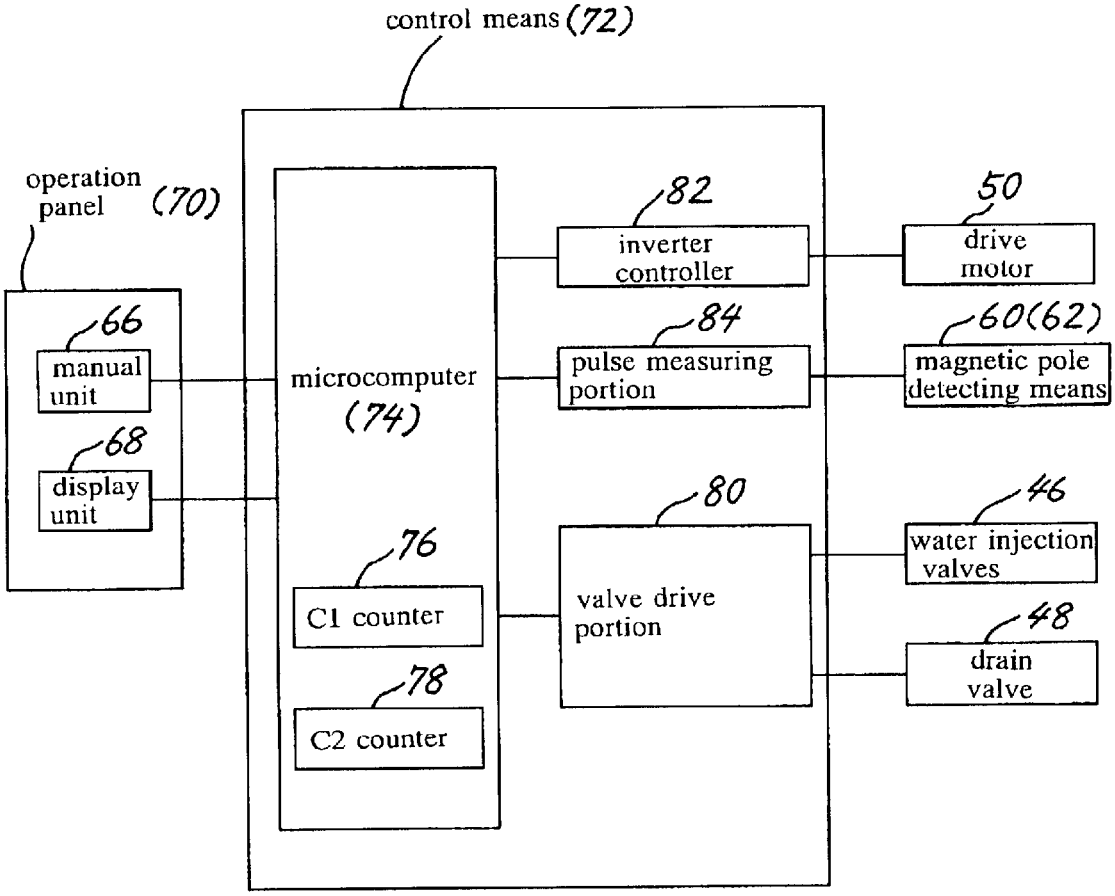
FIG. 3 is a block diagram showing control means.

All operations for controlling the drum-type washing machine 10 of the above construction are performed by the control means 72 provided at a suitable portion of the machine cabinet 12. As shown in FIG. 3, the control means 72 consists mainly of a microcomputer 74. The microcomputer 74 includes a memory (not shown) and counters 76, 78. The memory has stored therein an operation program for washing steps and various memory tables.

The manual unit 66 and the display unit 68 are connected to the control means 72. The manual unit 66 and the display unit 68 deliver input signals in accordance with the user's manipulation from the operation panel 70 on the machine cabinet 12 to the control means 72 and display information in accordance with the manipulation and states involving the operating state.

The microcomputer 74 includes a valve drive portion 80 for opening or closing the valves 46, 48, an inverter controller 82 for the drive motor 50, and pulse measuring portion 84 connected to the Hall elements 62. The microcomputer 74 feeds a rotational speed signal to the inverter controller 82, which converts this command signal to a PWM signal and applies to the drive motor 50 a drive voltage in accordance with the PWM signal, whereby the motor 50 is rotated forward or reversely at the desired speed of rotation. When the motor 50 in rotation is rotated in a direction opposite to the direction of the rotation, the motor is braked by the reverse rotation.

Figure 4:
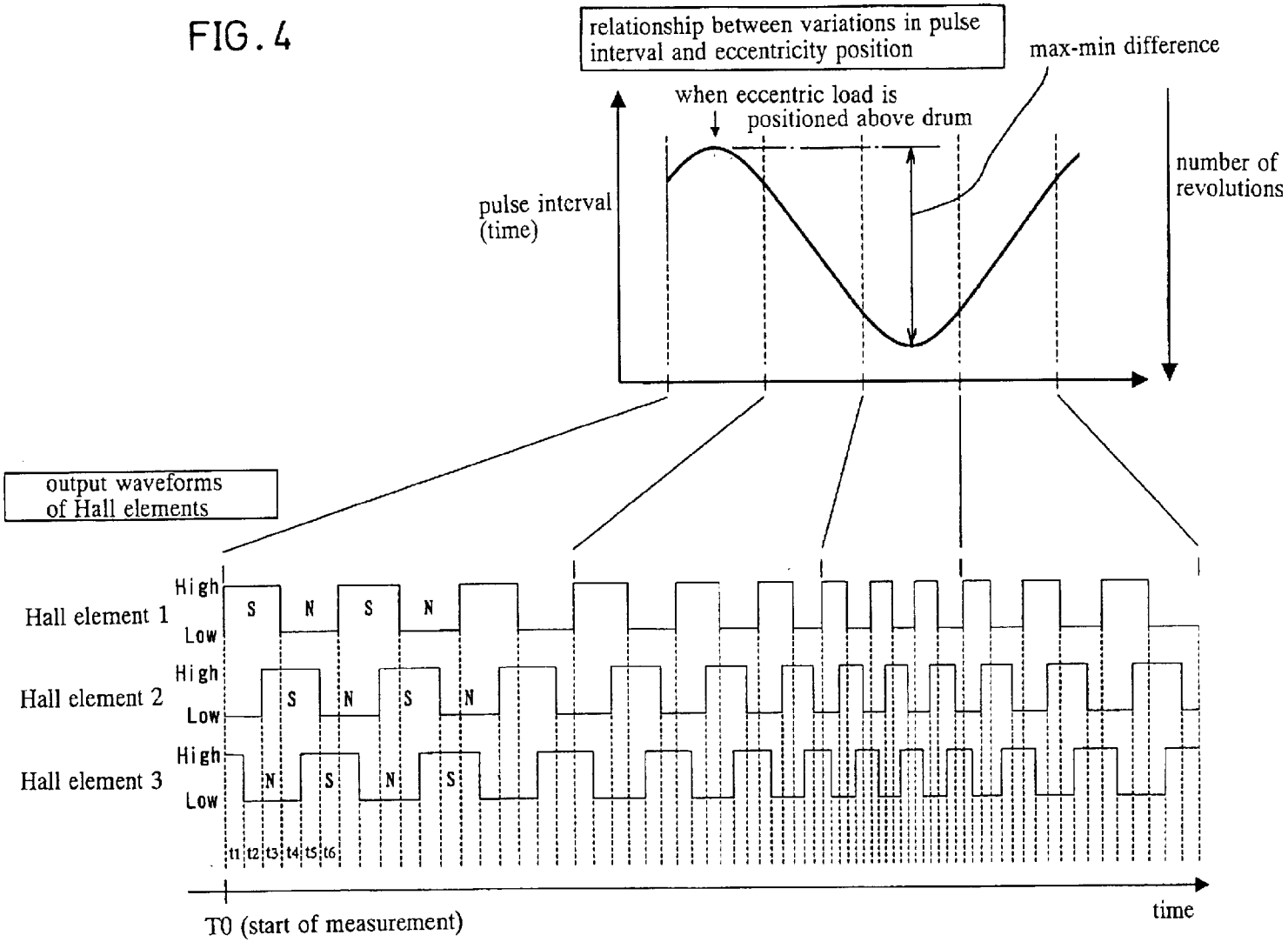
FIG. 4 is a graph showing relationship between the output pulses of Hall elements and the number of revolutions of a drive motor.
Figure 8:
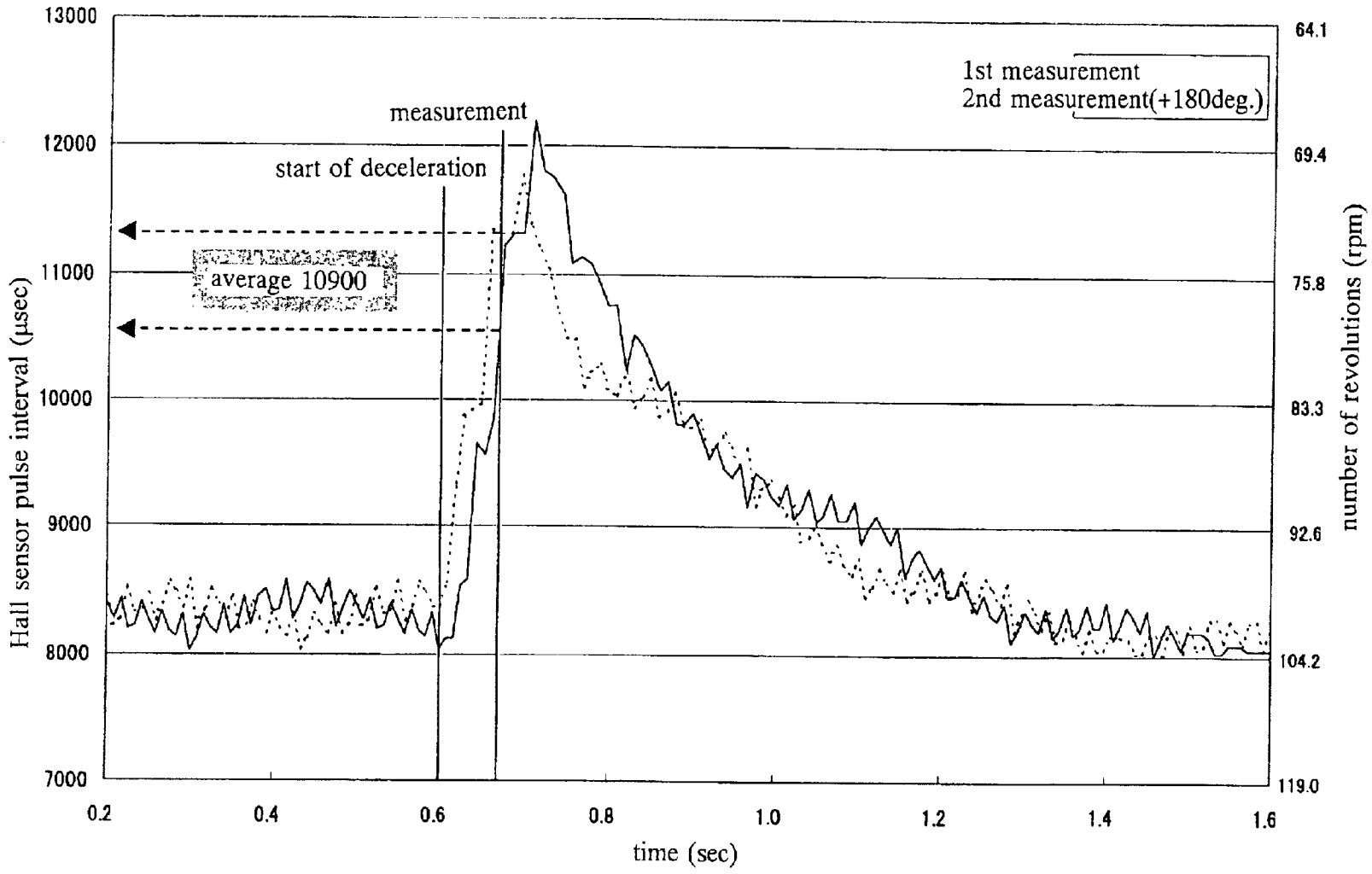
FIG. 8 is a graph showing pulse intervals of the Hall element detected for measuring the moment of inertia.
Figure 9:
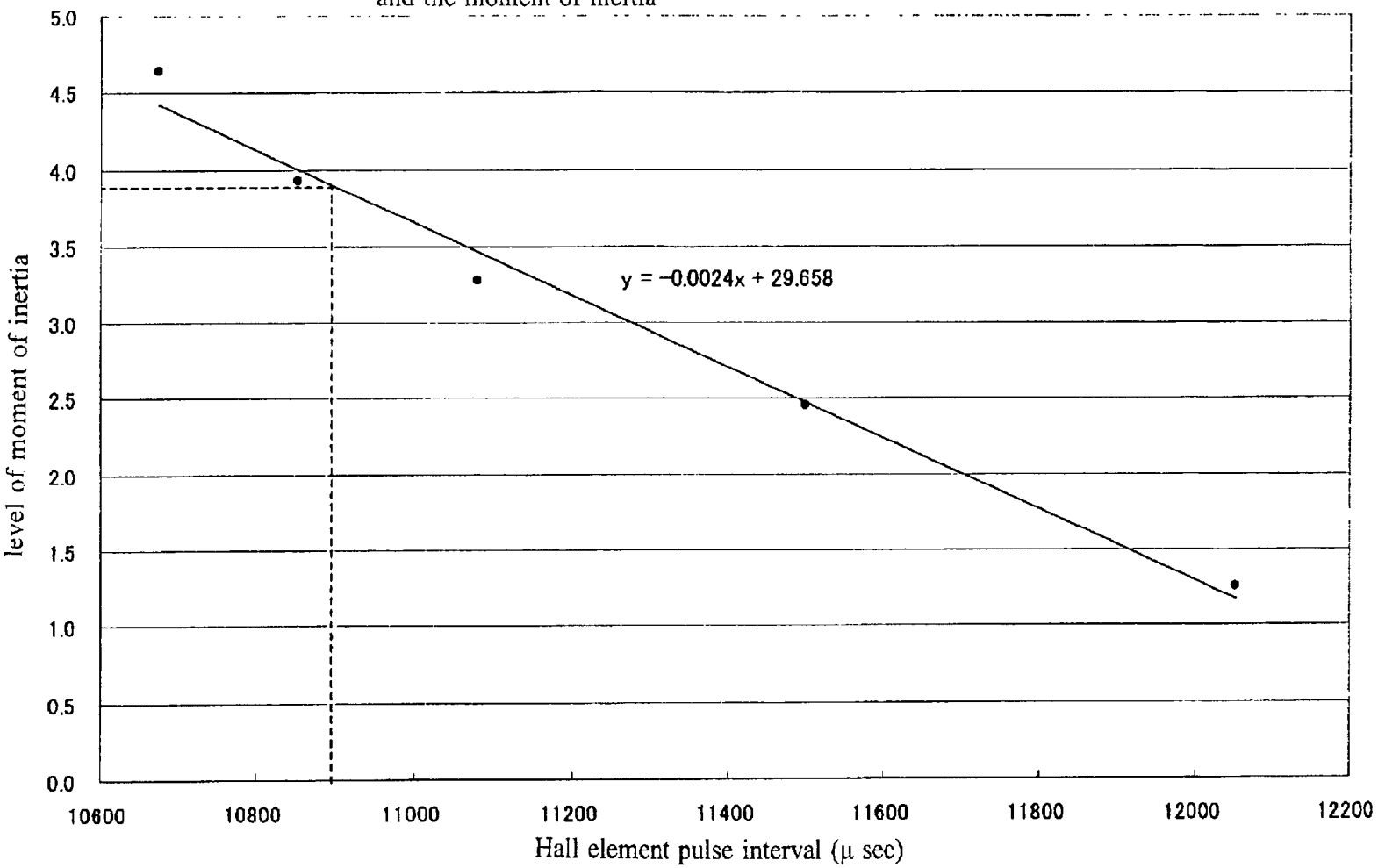
FIG. 9 is a graph showing the relationship between the pulse interval of the Hall elements and the level of moment of inertia.
Figure 10:
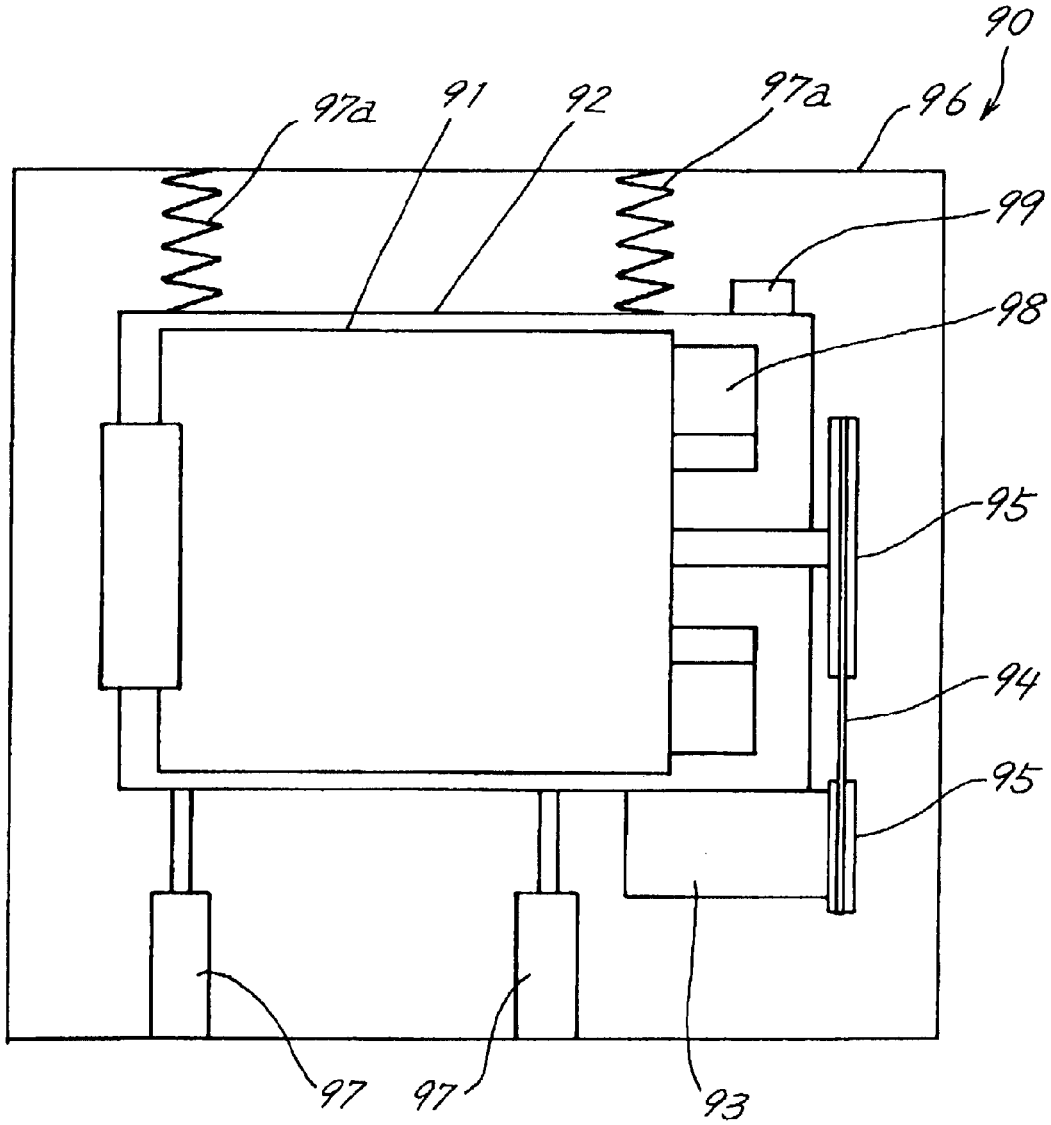
FIG.10 PRIOR ART
FIG. 10 is a view in section of a conventional drum-type washing machine.

The pulse measuring portion 84 receives high signals and low signals output when the Hall elements 62 detect the polarity of the magnetic poles 58 as shown in FIG. 4, measures the pulse interval of the received signals to determine the position and magnitude of eccentricity of the laundry, and also measures the moment of inertia of the drum as shown in FIGS. 8 and 9.

The position and magnitude of eccentricity of the laundry are measured in the following manner.

In the case where the laundry is not present unevenly within the drum 20, the pulse intervals of the signal output from the magnetic pole detecting means 60 during one turn of rotation of the rotor are definite.

However, if the laundry is present in the drum 20 unevenly inside the drum 20, the speed of rotation of the drum 20 fails to become constant owing to the eccentric load and varies during one turn of rotation as shown in FIG. 4. When the eccentric load (laundry) of the drum 20 moves past a position exactly above the center of rotation, the speed of rotation of the drive motor 50 connected directly to the drum 20 becomes slowest, and the interval of pulses output from the magnetic pole detecting means 60 increases. Conversely when the eccentric load moves past a position exactly below the center of rotation, the speed of rotation of the drum 20 and the drive motor 50 becomes highest, and the interval of pulses produced by the detecting means 60 becomes small. According, the position of eccentricity of the laundry can be specifically determined from the pulse interval.

Further the greater the eccentric weight of the laundry, the greater the variations in the speed of rotation of the drum 20 are. Accordingly, the magnitude of eccentric weight can be specifically determined by measuring the variations in the speed of rotation. As described above and as shown in FIG. 4, the speed of rotation can be calculated in terms of the pulse interval. The difference between the maximum of the pulse intervals and the minimum thereof indicates the magnitude of the eccentric weight.

The pulse measuring portion 84 measures the interval of the pulses output from the magnetic pole detecting means 60 for the microcomputer 74 to determine the position and magnitude of the eccentric load. Based on the information as to the position and magnitude of the eccentric load of laundry obtained, the amounts of water in the liquid holding chambers 36 close to the position of eccentric load are reduced relative to the amounts of water in the liquid holding chambers 36 remote from the eccentric load position to offset the eccentric load and ensure the weight balance of the drum 20.

The amounts of water in the liquid holding chambers 36 can be adjusted by two methods, i.e., a drain method and a water supply method.

The drain method comprises determining the position and magnitude of the eccentric load while rotating the drum 20, thereafter opening the water injection valves 46 to supply equivalent amounts of water to all the chambers 36, closing the valves 46, momentarily rotating the drive motor 50 reversely upon the position of eccentric load reaching a position exactly above the center of rotation to brake the motor by the reverse rotation and allow the water in the chambers 36 on the eccentric load side to fall spontaneously. Water may be held in the chambers 36 before determining the eccentric load position.

The water supply method comprises rotating the drum 20 with all the liquid holding chambers 36 made empty to determine the position of the eccentric load, braking the drive motor 50 by reverse rotation and opening the water injection valves 46 upon the position of eccentric load reaching a position exactly above the center of rotation to supply water to the chambers 36 positioned on the lower side opposite to the eccentric load.

The eccentric load on the drum 20 is offset by practicing either one of these methods.

If the magnitude of the reverse rotation braking force is constant in adjusting the amounts of water in the liquid holding chambers 36, the amounts of water in the chambers not located at the position of eccentricity are reduced due to the weight of the laundry in the drum 20, failing to correct the weight balance of the eccentric load. According to the invention, therefore, the weight of the laundry is measured from the moment of inertia acting on the drum 20 to cause the magnitude of reverse rotation braking force to reflect the measurement.

The moment of inertia of the drum 20 can be measured by driving the drive motor 50 to rotate the drum at a predetermined speed, detecting the degree of acceleration of the drive motor 50 when the motor is thereafter accelerated to a higher speed or detecting the degree of deceleration of the drive motor 50 when the motor 50 is braked by reverse rotation under predetermined conditions after rotating the drum at the predetermined speed, and comparing the detected value with data measured in advance. Usable as a parameter representing the moment of inertia is the speed of rotation or the number of revolutions of the drive motor 50 a specified period of time after the start of deceleration or acceleration, or the time taken for the motor to reach a predetermined speed of rotation.

Figure 7:
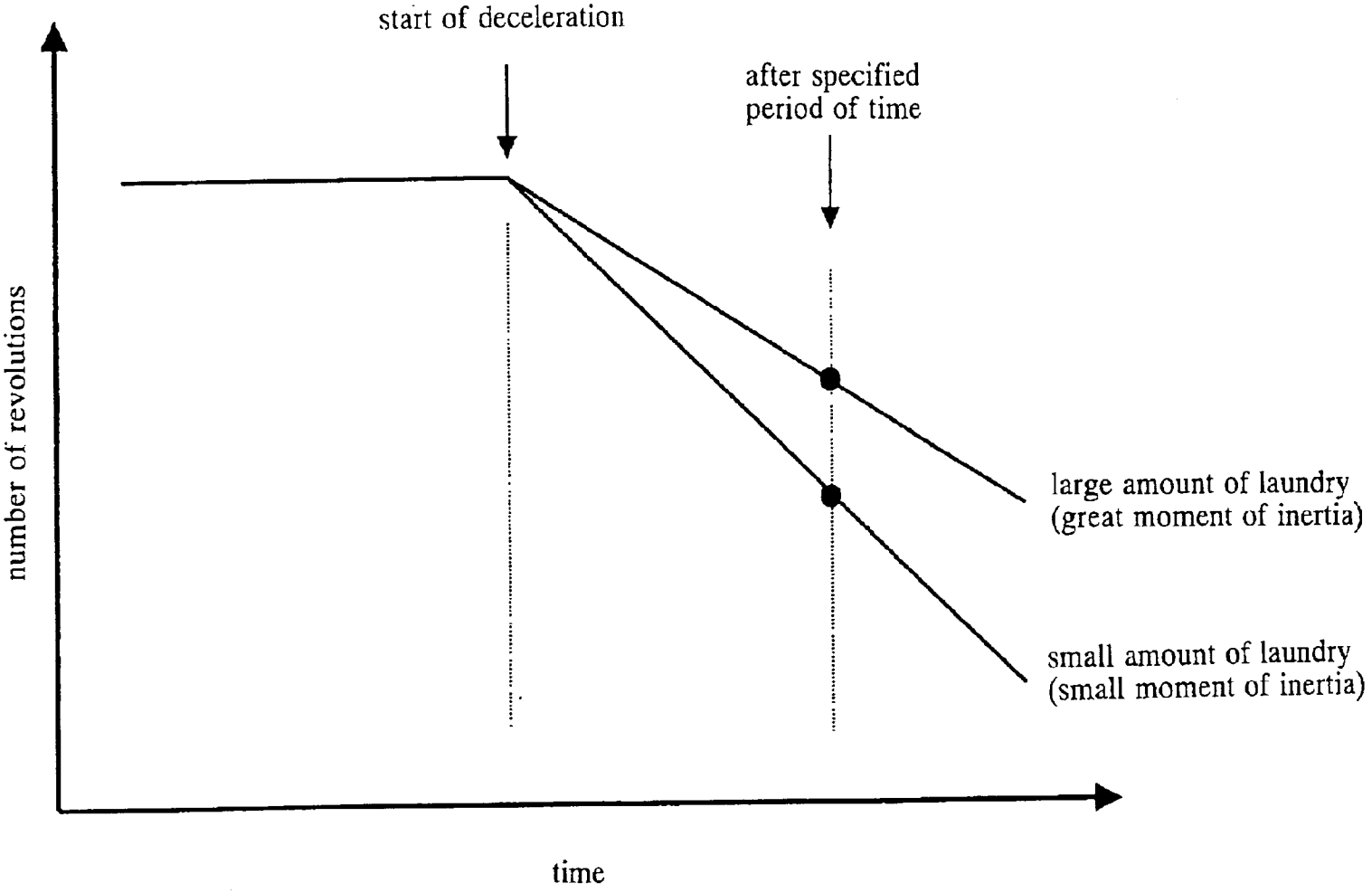
FIG. 7 is a graph showing the relationship between the number of revolutions of the drive motor, the amount of laundry and the moment of inertia.

FIG. 7 is a graph showing the decrease in the number of revolutions of the drive motor 50 when the motor is braked by reverse rotation while being driven at a predetermined number of revolutions. FIG. 7 shows the following. When the amount of laundry is great, the inertia of the drum 20 is great and the number of revolution of the drive motor 50 upon lapse of a specified period of time is therefore great. Conversely if the amount of laundry is small, the inertia of the drum 20 is also small, so that the number of revolutions of the motor 50 upon lapse of the specified period of time is small. Thus, the total weight of laundry within the drum 20 can be measured by measuring the moment of inertia acting on the drum 20.

To measure the moment of inertia, the interval of pulses output from the Hall elements 62 is measured by the pulse measuring portion 84.

FIG. 8 is a graph showing the intervals of output pulses from the Hall elements 62 when the drive motor 50 is braked by reverse rotation for 0.1 see while in rotation at 100 rpm. The graph shows that the brake is applied at the position of 0.6 sec to result in a longer pulse interval and a reduced number of revolutions. The pulse interval 0.07 sec after the application of the brake is measured, and the data obtained is converted to an inertial parameter. Since the influence on the rotation of the drive motor 50 differs depending on whether the eccentric load occurs during the decrease or increase in the speed of rotation, it is desirable to measure the interval several times at different points to ensure the accuracy of measurement. In the illustrated example, the interval was measured twice at points with a difference of 180 deg, and the average of the measurements was 10900 μsec.

FIG. 9 shows the data obtained by an experiment, i.e., the pulse interval of the Hall elements 62 plotted as x-axis and the moment of inertia as y-axis. The data affords an expression showing the relationship between the interval of pulses from the Hall elements 62 and the moment of inertia.

When the pulse interval measurement (10900 μsec) of FIG. 8 is applied to the relational expression of FIG. 9, the moment of inertia can be estimated at 3.8. The level of moment of inertia in FIG. 9 refers to a reference value indicating the magnitude of the moment of inertia; the greater this value, the greater the moment of inertia is, whereas the value does not represent the magnitude of the moment of inertia itself.

The control means 72 has stored therein in advance the relationship between the moment of inertia and the magnitude of reverse rotation braking force corresponding to the value of the moment of inertia. From the moment of inertia obtained, the magnitude of the reverse rotation braking force to be applied to the drive motor 50 is determined for the adjustment of the amounts of liquid in the chambers 36. When the magnitude of reverse rotation braking force is determined, the inverter controller 82 applies to the motor 50 a drive voltage corresponding to the magnitude of braking force to reversely rotate the motor 50.

The amounts of liquid in the liquid holding chambers 36 can be adjusted in corresponding relation with the position of eccentricity by adjusting the magnitude of braking force in accordance with the moment of inertia.

The drum-type washing machine 10 is controlled in the manner to be described below.

It is especially in the dewatering process that a need arises to suppress vibration or the like when an eccentric load occurs on the drum 20, so that the washing operation or rinsing operation will not be described, but the operation of the control means 72 and the washing machine 10 during the dewatering process will be described with reference to the flow charts of FIGS. 5 and 6.

Figure 5:
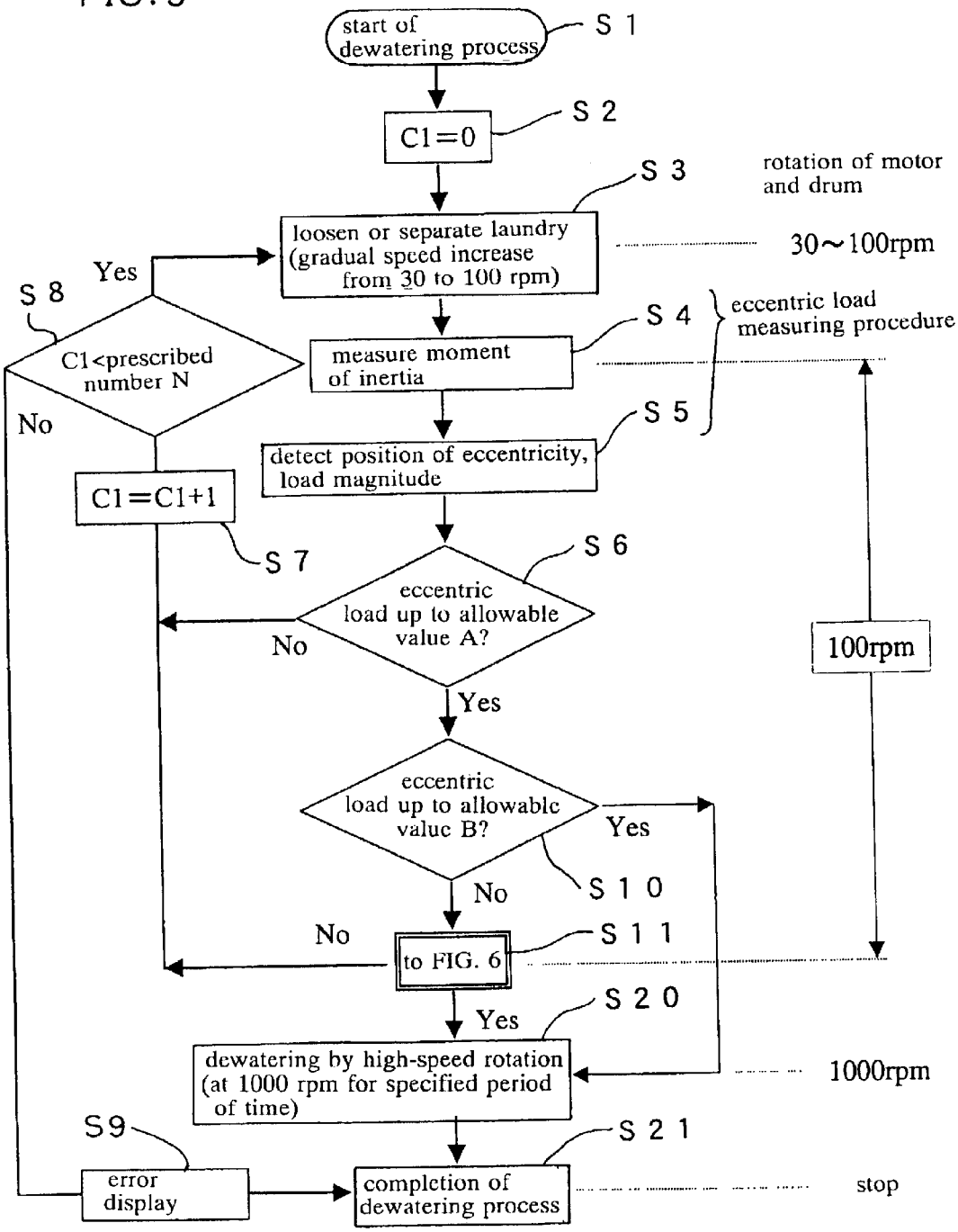
FIG. 5 is a flow chart showing a dewatering process.
Figure 6:
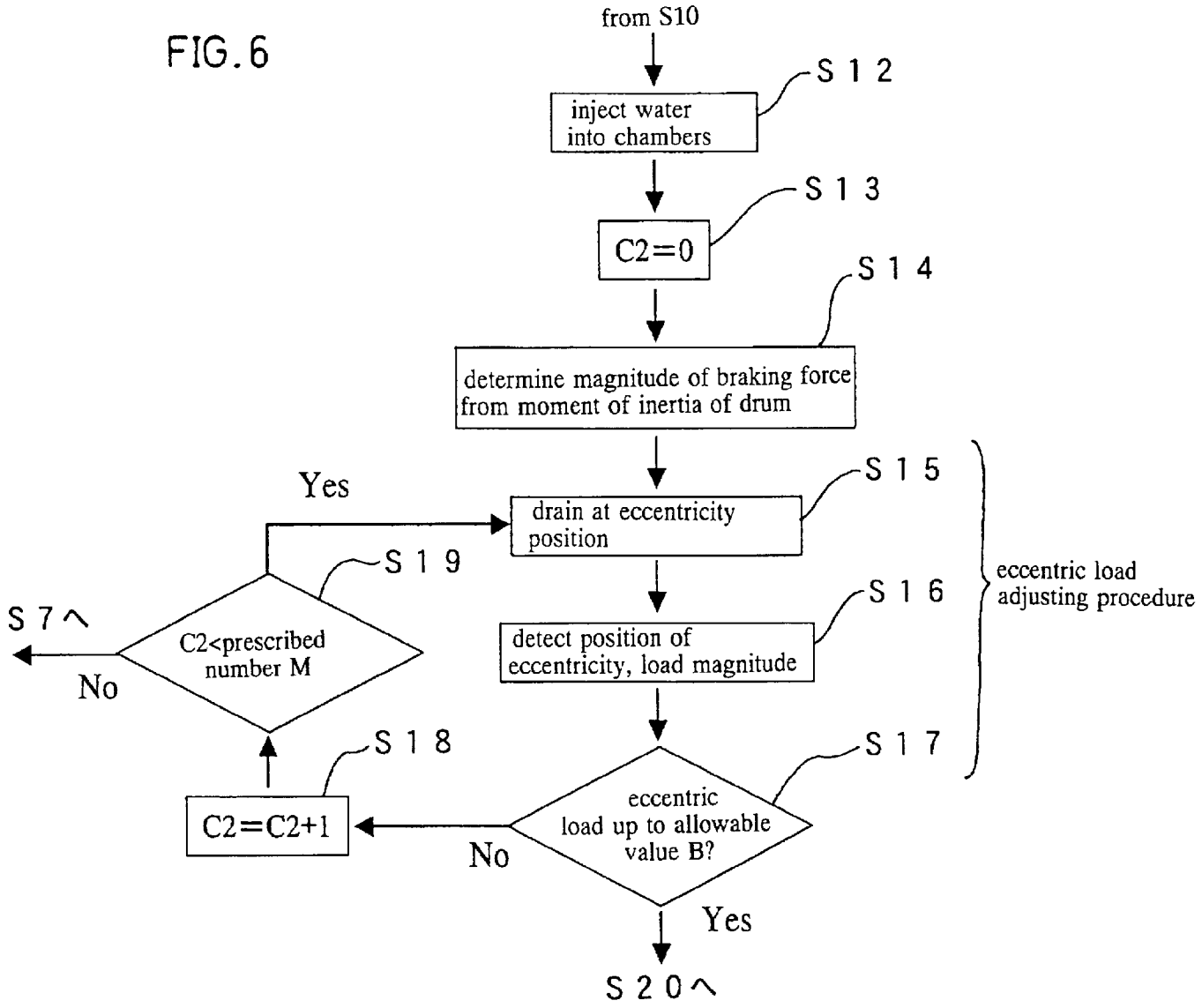
FIG. 6 is a flow chart showing an eccentric load adjusting procedure included in FIG. 5.

The dewatering process can be divided generally into an eccentric load measuring procedure represented by steps 4 and 5 in FIG. 5, an eccentric load adjusting procedure represented by steps 15 to 17 in FIG. 6, and a procedure for removing water from laundry by high-speed rotation, represented by step 20 in FIG. 5. An upper limit to the number of times the procedure is repeated is set for each of the eccentric load measuring procedure and the eccentric load adjusting procedure in view of the case wherein the measurement or adjustment of eccentric load can not be executed correctly. The numbers of times are counted by respective counters 76, 78 in the microcomputer 74 (step 7 and step 18).

After the rinsing operation or in response to the user's manipulation of the operation panel 70, the dewatering process is started (step 1).

In measuring an eccentric load, the counter 76 for counting the number of times C1 the eccentric load measuring procedure is conducted is reset (step 2).

The drive motor 50 is then driven to gradually increase the number of revolutions of the drum 20 from about 30 rpm to 100 rpm (step 3) to loosen or separate the laundry unevenly present in the drum 20 and to spread the laundry inside the drum 20 as uniformly as possible. The eccentric load measuring procedure is then performed.

The eccentric load measuring procedure has the step (step 4) of measuring the total weight of the laundry (including the weight of water) in the drum 20 from the moment of inertia of the drum 20, and the step (step 5) of measuring the position and magnitude of the eccentric load.

The moment of inertia of the laundry within the drum 20 is measured to determine the magnitude of reverse rotation braking force to be applied in step 14 (FIG. 6) to be described later. The position and magnitude of the eccentric load are measured for the adjustment of amounts of water in the liquid holding chambers 36 (step 16 in FIG. 6).

The moment of inertia involved in the rotation of the drum 20 is measured next (step 4).

The moment of inertia of the drum 20 can be measured by driving the drive motor 50 to rotate the drum 20 at a predetermined speed, thereafter braking the motor 50 by reverse rotation under specified conditions and detecting the speed of rotation of the motor 50 a predetermined period of time after braking. The speed of rotation of the drive motor 50 can be measured by measuring the output pulse interval of the Hall elements 62 by the pulse measuring portion 84. The measuring procedure has been already described in detail with reference to FIG. 8. The moment of inertia is calculated from the variations in the speed of rotation obtained.

After the moment of inertia of the drum 20 has been measured, the position and magnitude of the eccentric load are measured (step 5).

The position and magnitude of the eccentric load can be detected by rotating the drum 20, i.e., the drive motor 50, at a predetermined speed, e.g., at 100 rpm, and measuring the variations in the output pulse intervals of the Hall elements 62 during rotation over about 1.3 turns. The 1.3 turns of rotation is used because during one turn of rotation, the position of eccentricity is difficult to determine if the peak of output pulse appears at the start of measurement. During 1.3 turn of rotation, at least one maximum point can be detected from output pulses.

FIG. 4 is a graph showing the output pulses from the Hall elements 62 and the corresponding numbers of rotation of the drive motor 50. With reference to FIG. 4, when the laundry is positioned on the upper side of the center of rotation of the drum 20, the intervals t1, t2, . . . of pulses output from the Hall elements 62 are great, and the number of revolutions of the drive motor 50 is small, whereas when the laundry is positioned conversely on the lower side of the center of rotation of the drum 20, the output pulse intervals of the Hall elements 62 are small, with an increase in the number of revolutions of the drive motor 50.

The position of eccentricity of the laundry in the drum 20 is determined from this correlation.

Further the magnitude of eccentric load is determined from the difference between the maximum and the minimum of pulse intervals during one turn of rotation of the drive motor 50. In this case, the relationship between the pulse interval difference and the magnitude of the eccentric load is measured by experiments in advance and stored in the memory of the microcomputer 74.

The moment of inertia of the drum 20 and the position and magnitude of eccentric load of laundry can be determined by the eccentric load measuring procedure (step 4 and step 5).

Since the eccentric load is offset by adjusting the amounts of water in the liquid holding chambers 36 as stated above, there is a limit on the magnitude of eccentric weight which can be offset by the size of the chambers 36. Accordingly, an inquiry is made as to whether the eccentric load is of such magnitude that can be offset by the chambers 36 (step 6). If the magnitude of the eccentric load is in excess of an allowable value A, the load can not be offset, so that the number of times C1 the eccentric load measuring procedure is performed is incremented (step 7). If the number of times C1 is less than a prescribed number N, the sequence returns to step 3 again to loosen or separate the laundry to spread the laundry inside the drum 20 as uniformly as possible, followed by an eccentric load measuring procedure again. If the number of times C1 is in excess of N, this indicates that the eccentric load is not adjustable, and an error display is given on the display unit 68 (step 9), whereby the dewatering process is completed (step 21).

When the magnitude of eccentric load is up to the allowable value A, the eccentric load can be offset by adjusting the amounts of water in the chambers 36, so that the sequence proceeds to step 10.

An inquiry is made in step 10 as to whether there is a need to offset the eccentric load because if the magnitude of eccentric load is up to an allowable value B, almost no vibration or noise will occur due to the eccentric load even when water is removed from the laundry by high-speed rotation (step 20) without performing the eccentric load adjusting procedure. Accordingly, the eccentric load adjusting procedure (step 11) shown in FIG. 6 follows only when the magnitude of eccentric load is in excess of the allowable value B.

FIG. 6 is a flow chart showing the eccentric load adjusting procedure.

To start this procedure, the water injection valves 46 are opened to fill all the liquid holding chambers 36 with water (step 12).

When the chambers 36 have been filled up, the water injection valves 46 are closed, and the counter 78 for counting the number of times C2 the eccentric load measuring procedure is performed is reset (step 13).

Next, the magnitude of reverse rotation braking force is determined based on the moment of inertia measured in step 4 (step 14) to brake the drive motor by reverse rotation at the timing the laundry (eccentric load) moves past a position exactly above the center of rotation of the drum 20, causing the water in the chambers 36 on the eccentric load side to partly fall spontaneously for the adjustment of the eccentric load (step 15).

An inquiry is made as to whether the eccentric load of the drum 20 has been adjusted by step 15 by checking in the same manner as in the foregoing step 5 (step 16). If the resulting eccentric load is found to be (in step 17) up to the allowable value B (see the foregoing step 10), the eccentric load adjusting procedure is completed, followed by dewatering by high-speed rotation (step 20).

In the case where the eccentric load is in excess of the allowable value B, the number of times C2 the adjusting procedure is performed is incremented (step 18). When the number C2 is less than a prescribed number M, step 15 follows again for the adjustment of eccentric load.

If the number C2 is not smaller than the number M, step 7 follows again.

On completion of the adjustment of eccentric load, the drum 20 is held in rotation at about 1000 rpm for a specified period of time for the dewatering by high-speed rotation (step 20) to remove water from the laundry. Since the laundry is not present unevenly inside the drum 20, the vibration resulting from the high-speed rotation is small, while the noise involved in vibration can also be small.

The dewatering process is completed upon completion of the dewatering by high-speed rotation (step 21).

The present invention is applicable not only to washing machines for washing and dewatering but also to those having a drying function.

Apparently, the present invention can be modified and altered by one skilled in the art without departing from the spirit of the invention, and such modifications are included within the scope of the invention as set forth in the appended claims.

What is claimed is:

1. A drum type washing machine comprising:

a drum rotatable about a horizontal or inclined center of rotation with laundry placed therein for washing the laundry and dewatering therefrom, a drive motor for rotating the drum, a plurality of liquid holding chambers arranged circumferentially of the drum at equal intervals for holding a liquid therein by a centrifugal force produced by the rotation of the drum, means for detecting an eccentric load due to uneven presence of the laundry within the drum, and control means for determining the position and magnitude of the eccentric load detected and adjusting the amounts of liquid in the liquid holding chambers in accordance with the position and magnitude of the eccentric load, the amounts of liquid in the liquid holding chambers being adjustable by braking the drum in rotation, the drum-type washing machine being characterized in that the machine has moment of inertia measuring means for detecting the rotation of the drum, the control means being operable to calculate the moment of inertia acting on the drum based on the rotation of the drum detected by the moment of inertia measuring means and to adjust the magnitude of braking force to be applied to the drum in accordance with the calculated moment of inertia so as to decelerate the drum at a constant rate in adjusting the amounts of liquid in the liquid holding chambers.

2. They drum type washing machine according to claim 1 wherein the drive motor comprises a plurality of magnetic poles arranged alternately as a rotor and a plurality of coils arranged as a stator, and the moment of inertia measuring means is magnetic pole detecting means disposed in proximity to the rotor magnetic poles for detecting the polarity of the magnetic poles, the moment of inertial measuring means being operable to detect intervals of rotor polarity changes when the drum is decelerated or accelerated under predetermined conditions, the control means being operable to calculate the moment of inertia of the drum based on the detected intervals of polarity changes.

3. The drum type washing machine according to claim 2 wherein the moment of inertia measuring means is one or a plurality of Hall elements arranged in proximity to the rotor magnetic poles.

4. The drum type washing machine according to claim 3 wherein the drive motor has a rotation shaft connected directly to an end face of the drum.

5. The drum type washing machine according to claim 2 wherein the drive motor has a rotation shaft connected directly to an end face of the drum.

6. The drum type washing machine according to claim 1 wherein the moment of inertia measuring means is one or a plurality of Hall elements arranged in proximity to the rotor magnetic poles.

7. The washing machine of the drum type according to claim 6 wherein the drive motor has a rotation shaft connected directly to an end face of the drum.

8. The drum type washing machine according to claim 1 wherein the drive motor has a rotation shaft connected directly to an end face of the drum.

* * * * *